US008532523B2

(12) United States Patent
Ishiguro et al.

(10) Patent No.: US 8,532,523 B2
(45) Date of Patent: Sep. 10, 2013

(54) TONER CARTRIDGE HAVING A TONER FLOWING-OUT PREVENTING MEMBER AND IMAGE FORMING APPARATUS USING THE SAME

(75) Inventors: Yasuyuki Ishiguro, Osaka (JP); Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 379 days.

(21) Appl. No.: 12/878,248

(22) Filed: Sep. 9, 2010

(65) Prior Publication Data

US 2011/0064481 A1 Mar. 17, 2011

(30) Foreign Application Priority Data

Sep. 15, 2009 (JP) ..... 2009-213813

(51) Int. Cl.
*G03G 15/08* (2006.01)

(52) U.S. Cl.
USPC ..... 399/105; 399/106; 399/263

(58) Field of Classification Search
USPC ..... 399/102, 103, 105, 106, 263
See application file for complete search history.

(56) References Cited

U.S. PATENT DOCUMENTS

| | | | | |
|---|---|---|---|---|
| 4,937,625 | A * | 6/1990 | Kato et al. | |
| 7,194,230 | B2 * | 3/2007 | Haruyama | 399/106 |
| 2009/0162107 | A1 | 6/2009 | Yoshikawa et al. | |
| 2011/0064474 | A1 * | 3/2011 | Funada | |
| 2011/0222917 | A1 * | 9/2011 | Ichikawa | 399/263 |

FOREIGN PATENT DOCUMENTS

| | | | |
|---|---|---|---|
| CN | 101464648 | A | 6/2009 |
| JP | 2000-214667 | A | 8/2000 |
| JP | 2003-233247 | A | 8/2003 |
| JP | 2007-086311 | A | 4/2007 |
| JP | 2008-129561 | A | 6/2008 |

* cited by examiner

*Primary Examiner* — David Gray
*Assistant Examiner* — Laura Roth
(74) *Attorney, Agent, or Firm* — Renner, Otto, Boisselle & Sklar, LLP

(57) ABSTRACT

A toner cartridge includes a container for containing toner, a toner discharge section having a toner discharge port, an auger screw provided in the container, for conveying toner in the container to the toner discharge section, a shutter for opening and closing the toner discharge port, and a toner flowing-out preventing member provided in a communicating part between the container and the toner discharge section, for preventing flowing out of toner by closing an opening of the communicating part. The toner flowing-out preventing member is configured so as to open the opening in conjunction with an opening operation of the shutter.

4 Claims, 7 Drawing Sheets

TONER CARTRIDGE HAVING A TONER FLOWING-OUT PREVENTING MEMBER AND IMAGE FORMING APPARATUS USING THE SAME

CROSS-REFERENCE TO RELATED APPLICATION

This application claims priority to Japanese Patent Application No. 2009-213813, which was filed on Sep. 15, 2009, the content of which is incorporated herein by reference in its entirety.

BACKGROUND OF THE INVENTION

1. Field of the Invention

The present invention relates to a toner cartridge for use in an image forming apparatus such as a laser beam printer or a multi-functional peripheral, particularly to a toner cartridge for containing toner disposed so as to be exchangeable such as a toner hopper and a toner bottle, and an image forming apparatus using the same.

2. Description of the Related Art

Conventionally, an image forming apparatus using electrophotography such as a copying apparatus, a facsimile apparatus, a printer or a multi-functional peripheral having these functions, using a two-component developer is configured to perform a continuous operation of outputting an image by automatically supplying toner to a developing device by a toner supply apparatus using a toner cartridge or the like. Then, in toner shortage, a toner cartridge, a process cartridge, etc. can be easily replaced to supply toner.

Toner containers such as toner cartridges or process cartridges are, when stored in a warehouse or the like, sometimes stacked to face various directions without the stacking directions being controlled. For example, for toner cartridges of a type which discharges toner from one end side of a cartridge main body thereof, when stacked vertically so that a side of a toner discharge port face downward, toners inside the cartridges go down with their own weight as time elapses, therefore, toner density near the toner discharge port becomes high. As a result, toners may aggregate or become an agglomerate to clog the toner discharge port in a serious case.

In the case where the toner cartridge in the above-described state is newly mounted on the image forming apparatus, toner is hard to be discharged from the toner cartridge, and in the worst case, it is possible to be judged as being out of toner even though a large amount of the toner are left in the toner cartridge. Therefore, when newly mounting a toner cartridge, although such a countermeasure that the cartridge is shaken several times before mounting is performed, nevertheless such a problem occurs. Particularly, with a latest toner whose low temperature fixation property is improved for an energy saving measure, preservation stability is deteriorated, and therefore, in a state of being naturally left, there is a tendency that the toner aggregation easily occurs.

In a latest image forming apparatus, reducing the size thereof is required, and therefore, the sizes of a toner container and a developing device are reduced in association therewith, and thus a space of setting those is also made to be smaller. Accordingly, the condition where each of units is closely stuffed up causes a condition where the toner aggregation easily occurs. In mounting the toner cartridge has been stored in the warehouse on the image forming apparatus, even though the user or the like is requested to mount the toner cartridge after shaking it, the user or the like often forgets to do so, so that the toner may not be discharged as a result, and thus causing a trouble such as detection of shortage of toner concentration in a developer or stopping of an image forming apparatus itself. To counter with this problem, for example, Japanese Unexamined Patent Publication JP-A 2000-214667 discloses a developer supplying apparatus in which a part of a conveying spiral of a conveying auger provided in a toner cartridge is cut to reduce pressure of the toner.

However, even in the case of JP-A 2000-214667, there has been a problem that when fluidity of the toner is lost (to be put into a state of loose aggregation) as the toner cartridge has been left for a long time while a toner discharge port is faced downward, in a first toner supply operation after mounted in the image forming apparatus, that is, in rotation of the auger screw, toner near the toner discharge port is not discharged to the outside of the toner cartridge and as a result, toner which had nowhere to go is fixed as compressed by the pressure of the auger screw, and thus the rotation of the auger screw is locked.

SUMMARY OF THE INVENTION

An object of the invention is to provide a toner cartridge capable of preventing agglomeration of toner at a toner discharge port and preventing such a defect that rotation of an auger screw is locked, and an image forming apparatus using the same.

The invention provides a toner cartridge comprising:

a container for containing toner, having an opening for discharging the contained toner;

a toner discharge section provided through a communicating part at a side part of the container where the opening is provided, having a discharge port for discharging toner;

an auger screw provided with a rotation shaft and a spiral blade and rotatably supported in the container, for conveying toner in the container from the opening to the toner discharge section;

a shutter for opening and closing the discharge port; and a toner flowing-out preventing member provided in the communicating part, for opening and closing the opening, the toner flowing-out preventing member being operated in conjunction with the shutter such that when the discharge port is in an opened state, the opening is in an opened state, and when the discharge port is in a closed state, the opening is in a closed state.

According to the invention, by action of the spiral blade accompanying a rotation of the rotation shaft of the auger screw provided in the container, toner contained in the container is conveyed to the toner discharge section. Then, by providing the toner flowing-out preventing member in the communicating part between the container and the toner discharge section, toner flowing into the toner discharge section having the toner discharge port is able to be controlled. As a result, in shipping the toner cartridges, locking phenomenon of the auger screw which occurs by the toner compressed by the pressure of the auger screw to be fixed is able to be prevented by preventing the toner from entering into the toner discharge section from the toner container. Further, an unexpected flowing out of the toner which is triggered by vibrations or the like when the auger screw is stopped is able to be prevented. Moreover, the toner flowing-out preventing member is configured to open and close the opening in conjunction with the opening operation of the shutter, and thus a special mechanism for releasing the toner flowing-out preventing member is not necessary to be provided, therefore, it is possible to design the toner cartridge to be compact.

Further, in the invention, it is preferable that a cross section perpendicular to the rotation shaft of an internal space enclosed by the toner discharge section and the shutter is composed of a rectangular part on a side of the shutter and a semi-arc part on a side opposite to the shutter, which rectangular part and semi-arc part continue into each other, and the toner flowing-out preventing member has a circular hole section whose shape is the same as the sectional shape of the rotation shaft of the auger screw, has an entire shape the same shape as the sectional shape of the internal space, and has a side end of the rectangular part fixed to the shutter, and when the opening is in the closed state, the rotation shaft of the auger screw is inserted to the circular hole section, and the toner flowing-out preventing member is held by the auger screw in a state of being perpendicular to an axial line of the rotation shaft.

According to the invention, since the sectional shape of the internal space which is enclosed by the toner discharge section and the shutter is formed to be the same as the sectional shape of the toner flowing-out preventing member, and in the closed state of the opening, the toner flowing-out preventing member is held in the state of being perpendicular to the axial line of the rotation shaft with respect to the auger screw, and thereby flowing-out of the toner in the toner container is able to be prevented effectively by the toner flowing-out preventing member. Further, since the toner flowing-out preventing member is held by the auger screw in the state where the rotation shaft is inserted to the circular hole section thereof, a load of departing from the auger screw in releasing the toner flowing-out preventing member in conjunction with the opening operation of the shutter will not be excessively high.

Further, in the invention, it is preferable that a notch section for the toner flowing-out preventing member having a width equal to or more than a thickness of the toner flowing-out preventing member is provided on the spiral blade of the auger screw, and when the opening is in the closed state, a part of the toner flowing-out preventing member is positioned in the notch section.

According to the invention, in the holding state of the toner flowing-out preventing member by the auger screw, a part of the toner flowing-out preventing member is positioned in the notch section, and therefore, in transporting the toner cartridges, even when the auger screw rotates, the spiral blade does not act on the toner flowing-out preventing member. Therefore, flowing-out of the toner from the container is able to be prevented without the toner flowing-out preventing member being deformed or fallen down so as to be held stably.

Further, in the invention, it is preferable that the toner flowing-out preventing member has a notch from the circular hole section to a peripheral part of a region corresponding to the semi-arc part of the internal space.

According to the invention, in opening the opening in conjunction with the opening operation of the discharge port of the shutter, the notch is widely opened receiving the action of the rotation shaft of the auger screw in the circular hole section, thereby the load of the toner flowing-out preventing member departing from the auger screw becomes small, and the release of the toner flowing-out preventing member is able to be achieved more smoothly.

The invention provides an image forming apparatus comprising:

a photoreceptor drum on which an electrostatic latent image is to be formed;

a developing device for developing a toner image by supplying toner to the electrostatic latent image formed on the surface of the photoreceptor drum;

the toner cartridge mentioned above, for supplying toner to the developing device;

a transfer device for transferring on a recording medium the toner image developed on the surface of the photoreceptor drum; and a fixing device for fixing the transferred toner image on the recording medium.

According to the invention, image formation is achieved by a series of processing of electrophotography comprising forming an electrostatic latent image on the surface of the photoreceptor drum, forming a toner image by developing the electrostatic latent image by the developing device, transferring the toner image on the recording medium by the transfer device, and then fixing it thereon by the fixing device. In the process of the image formation, the auger screw in the toner cartridge is activated as needed so that supplying of toner from the toner cartridge to the developing device is achieved. In the process of the toner cartridge from a state of being kept to a state of being mounted in the image forming apparatus, inflow of the toner from the container to the toner discharge section is prevented, and therefore, a situation where toner near the toner discharge port is compressed to be fixed by the pressure of the auger screw during rotation of the auger screw after opening the shutter and after releasing the toner flowing-out preventing member at the time of mounting the toner cartridge in the image forming apparatus so that auger screw is locked, will not occur and supplying of toner to the developing device is able to be achieved without fail. Thereby the toner concentration is able to be controlled stably so as to obtain the stable image concentration over a long term.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
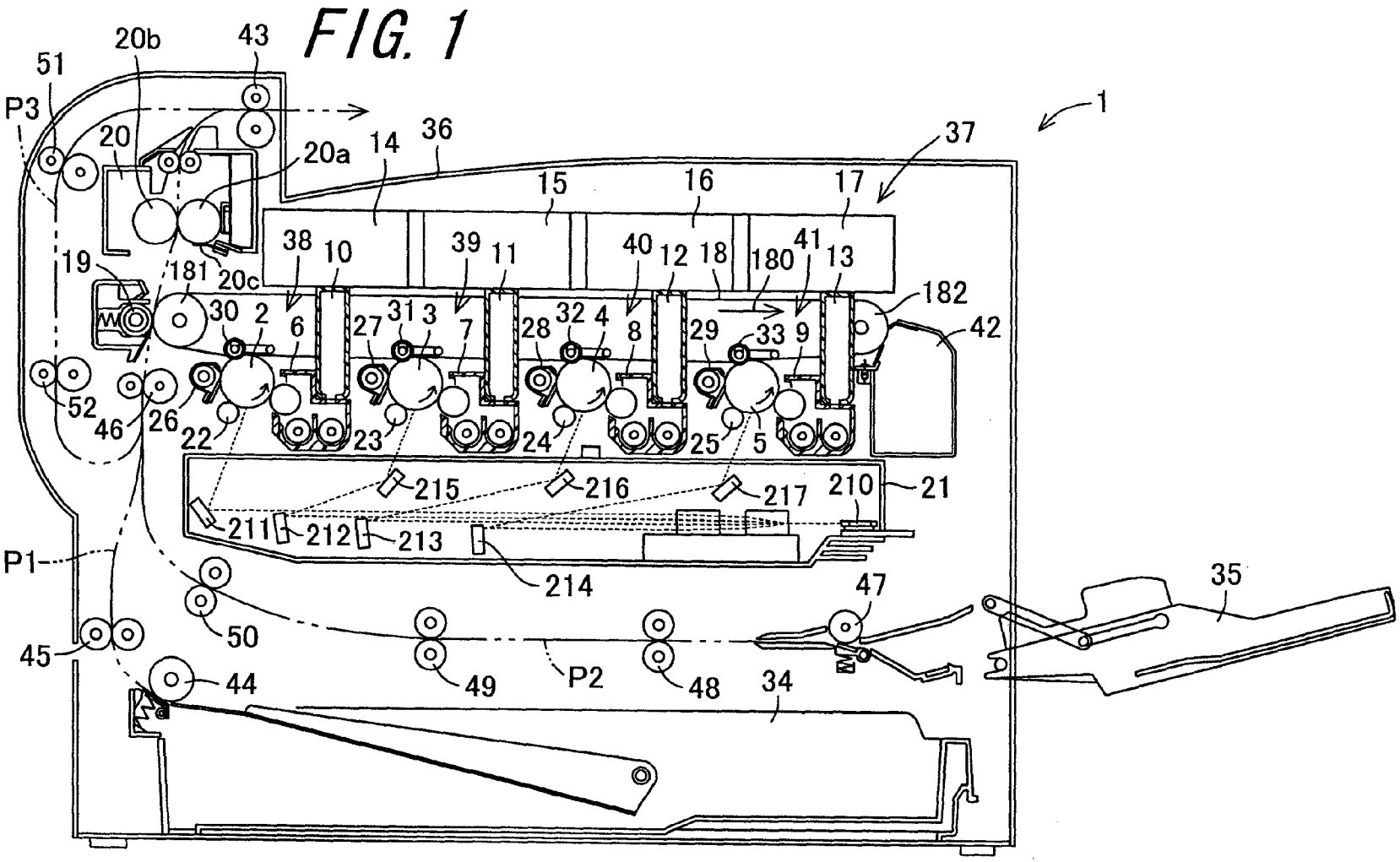
FIG. 1 is a schematic view showing an entire configuration of an image forming apparatus according to a first embodiment of the invention.

Now referring to the drawings, preferred embodiments of the invention are described below.

Hereinafter, description will be given for preferred embodiments of the invention with reference to the drawings. FIG. 1 is a schematic view showing an entire configuration of an image forming apparatus 1 according to a first embodiment of the invention. The image forming apparatus 1 according to the embodiment includes, as shown in FIG. 1, photoreceptor drums 2, 3, 4 and 5 on which electrostatic latent images are to be formed, developing devices 6, 7, 8 and 9 which form toner images by supplying toners to the electrostatic latent images on the surfaces of the photoreceptor drums 2, 3, 4, and 5, toner cartridges 14, 15, 16 and 17 which supply toners to the developing devices 6, 7, 8 and 9 through toner supply pipes 10, 11, 12 and 13 as toner supply members, a secondary transfer roller 19 as a transfer device configured to transfer the toner images on the surfaces of the photoreceptor drums 2, 3, 4 and 5 to a paper sheet with an intermediate transfer belt 18 interposed therebetween, and a fixing device 20 configured to fix the toner images on the paper sheet, and forms an image with using toner by electrophotography. Then, it is preferable that the toner cartridges 14, 15, 16 and 17 for use in the image forming apparatus 1 are provided with unique configurations which will be described below.

The image forming apparatus 1 according to the embodiment forms as a visible image a multi-color image on a predetermined sheet (recording paper) as a recording medium based on image data included in an input command such as image data transmitted from outside through a communication network or the like. The image forming apparatus 1 includes, as shown in FIG. 1, an exposure unit 21, photoreceptor drums 2, 3, 4 and 5 corresponding to image bearing members on which latent images are to be formed by the exposure unit 21, developing devices 6, 7, 8 and 9, charging rollers 22, 23, 24 and 25, cleaning units 26, 27, 28 and 29, the intermediate transfer belt 18, primary transfer rollers 30, 31, 32 and 33, the secondary transfer roller 19, the fixing device 20, paper conveyance paths P1, P2, P3, a paper feeding cassette 34, a manual paper feeding tray 35, a paper discharge tray 36, a toner cartridge unit 37 and the like.

As the image data of a color image which the image forming apparatus 1 deals with, the image data corresponding to each color of four colors including black (K), cyan (C), magenta (M), and yellow (Y) is used to perform formation of visible images in image forming sections 38, 39, 40 and 41. The image forming sections 38, 39, 40 and 41 correspond to color images using each of the colors. Accordingly, the charging rollers 22, 23, 24 and 25, the photoreceptor drums 2, 3, 4 and 5 and developing devices 6, 7, 8 and 9 are provided by four pieces respectively so that four kinds of latent images and toner images corresponding to each color are formed, and the cleaning units 26, 27, 28 and 29 and the primary transfer rollers 30, 31, 32 and 33 are also provided by four pieces corresponding thereto respectively. Each of the image forming sections 38, 39, 40 and 41 is configured similarly, and for example, the image forming section 38 of the black is configured by the photoreceptor drum 2, the developing device 6, the charging roller 22, the transfer roller 30 and the cleaning unit 26, etc.

The image forming sections 38, 39, 40 and 41 are arrayed in a line in a moving direction (sub-scanning direction) of the intermediate transfer belt 18. Note that, the image forming section 38 corresponds to black, the image forming section 39 corresponds to cyan, the image forming section 40 corresponds to magenta, and the image forming section 41 corresponds to yellow, and four image stations are configured by the above-described each section distinguished by each of these numeral references.

The exposure unit 21 which is the exposure device of the embodiment includes a semiconductor laser (not shown) as a laser light source, a polygonal mirror 210, first reflection mirrors 211, 212, 213 and 214, and second reflection mirrors 215, 216 and 217 etc., and with the image data of each color of black, cyan, magenta and yellow, each light beam of modulated laser beam or the like is irradiated to each of the photoreceptor drums 2, 3, 4, and 5. To each of the photoreceptor drums 2, 3, 4 and 5, an electrostatic latent image by the image data of each color of black, cyan, magenta and yellow is formed.

In the embodiment, although the exposure unit 21 is one with a technique using a laser scanning unit (LSU) including a laser irradiation section and a reflection mirror, one with a technique in which light emitting elements are arranged in an array using EL or LED write head, for example, may be used.

The photoreceptor drums 2, 3, 4 and 5 are arranged above the exposure unit 21, are image bearing members each having a substantially cylinder shape, and are controlled to rotate in a predetermined direction (refer to an arrow attached to each of the photoreceptor drums 2, 3, 4 and 5) by a driving section and a control section which are not shown. The photoreceptor drums 2, 3, 4 and 5 are so configured that a photoconductive layer is formed on a conductive substrate. For example, a metal drum made of aluminum or the like is the substrate, and on the outer circumferential surface thereof, the photoconductive layer of amorphous silicon (a-Si), selenium (Se), or organic photo-semiconductor (OPC) etc., is formed as a thin film. Note that, the configuration of the photoreceptor drums 2, 3, 4 and 5 is not particularly limited to the above-described configuration. The charging rollers 22, 23, 24 and 25 are chargers of a contact type which charge the surfaces of the photoreceptor drums 2, 3, 4 and 5 uniformly to predetermined potential. In the embodiment, as shown in FIG. 1, although charging rollers 22, 23, 24 and 25 of a roller type and the contact type are used as the chargers, in replacement of such charging rollers 22, 23, 24 and 25, chargers of a charger type or a brush type may be used.

The developing devices 6, 7, 8 and 9 supply toner to the surfaces of the photoreceptor drums 2, 3, 4 and 5 on which the electrostatic latent images are formed, to develop the electrostatic latent images to the toner images. Each of the developing devices 6, 7, 8 and 9 contains toner of each of the colors of black, cyan, magenta, and yellow, and visualize the electrostatic latent image corresponding to each of the colors formed on each of the surfaces of the photoreceptor drums 2, 3, 4 and 5 into the toner image of each of the colors of black, cyan, magenta and yellow. The cleaning units 26, 27, 28 and 29 remove and collect residual toners on the surfaces of the photoreceptor drums 2, 3, 4 and 5 with a lubricant or the like after development and image transfer.

The intermediate transfer belt 18 arranged above the respective photoreceptor drums 2, 3, 4 and 5 is supported around a driving roller 181 and a driven roller 182 with tension, and forms a loop-shaped moving path. The photoreceptor drum 5 (yellow), the photoreceptor drum 4 (magenta), the photoreceptor drum 3 (cyan) and the photoreceptor drum 2 (black) are arranged in this order to face the outer circumferential surface of the intermediate transfer belt 18 along with a moving direction 180 thereof. The primary transfer rollers 30, 31, 32 and 33 are arranged at positions facing the respective photoreceptor drums 2, 3, 4 and 5 with the intermediate transfer belt 18 interposed therebetween. The respective positions at which the intermediate transfer belt 18 faces the photoreceptor drums 2, 3, 4 and 5 are primary transfer positions. The intermediate transfer belt 18 is a film having a thickness of about 100 to 150 μm, and formed to be an endless-shape. A primary transfer bias having opposite polarity to charging polarity of the toner is applied by constant voltage control to the primary transfer rollers 30, 31, 32 and 33 in order to transfer the toner images borne on the surfaces of the photoreceptor drums 2, 3, 4 and 5 onto the intermediate transfer belt 18. Thereby, the toner images of the respective colors formed on the photoreceptor drums 2, 3, 4 and 5 are transferred and overlaid onto the outer circumferential surface of the intermediate transfer belt 18 sequentially, and a full-color toner image is formed on the outer circumferential surface of the intermediate transfer belt 18.

However, when image data for only a part of the colors of yellow, magenta, cyan and black is inputted, electrostatic latent images and toner images are formed at only a part of the photoreceptor drums corresponding to the color of the input image data among the four photoreceptor drums 2, 3, 4 and 5. For example, during monochrome image formation, formation of an electrostatic latent image and formation of a toner image are performed only at the photoreceptor drum 2 corresponding to the color of black, and only a black toner image is transferred onto the outer circumferential surface of the intermediate transfer belt 18.

Each of the primary transfer rollers 30, 31, 32 and 33 is configured by coating a surface of a shaft whose raw material is metal having a diameter of 8 to 10 mm (stainless steel, for example) with a conductive elastic material (such as EPDM, urethane foam, etc.), and applies high voltage uniformly to the intermediate transfer belt 18 by the conductive elastic material. In the embodiment, although the primary transfer rollers 30, 31, 32 and 33 are used as transfer electrodes, other than them, a brush or the like is also usable. The toner image transferred onto the outer circumferential surface of the intermediate transfer belt 18 at each primary transfer position is conveyed to a secondary transfer position, which is a position facing the secondary transfer roller 19, by the rotation of the intermediate transfer belt 18 along the moving direction 180. The secondary transfer roller 19 is in pressure-contact, at a predetermined nip pressure, with the outer circumferential surface of the intermediate transfer belt 18 whose inner circumferential surface is in contact with a circumferential surface of an intermediate transfer belt driving roller 181 during image formation. To obtain the nip pressure constantly, either of the secondary transfer roller 19 or the intermediate transfer belt driving roller 181 is formed by a hard material such as metal, and another one is formed by a soft material such as an elastic roller or the like (elastic rubber roller, foamable resin roller, etc.).

When a paper sheet fed from a paper feeding cassette 34 or a manual paper feeding tray 35 passes through between the secondary transfer roller 19 and the intermediate transfer belt 18, high voltage with opposite polarity (+) to the charging polarity of the toner (−) is applied to the secondary transfer roller 19. As described above, the electrostatic latent images formed on the surfaces of respective photoreceptor drums 2, 3, 4 and 5 are visualized by the toner corresponding to each of the colors to form respective toner images, and such toner images are layered on the intermediate transfer belt 18. Thereafter, the layered toner images are moved to a contact position of the conveyed paper sheet with the intermediate transfer belt 18 by the rotation movement of the intermediate transfer belt 18, and by the secondary transfer roller 19 arranged in this position, the toner images are transferred from the outer circumferential surface of the intermediate transfer belt 18 onto the paper sheet.

Toners adhered to the intermediate transfer belt 18 by the contact of the intermediate transfer belt 18 with the photoreceptor drums 2, 3, 4 and 5, and toners remaining on the intermediate transfer belt 18 without being transferred in transferring the toner image from the intermediate transfer belt 18 to the paper sheet become a source of causing color mixture of the toner at the next step, therefore removal and collection thereof are performed by an intermediate transfer belt cleaning unit 42. The intermediate transfer belt cleaning unit 42 is provided with, for example, a cleaning blade as a cleaning member that is in contact with the intermediate transfer belt 18. A part of the intermediate transfer belt 18 where the cleaning blade is in contact therewith is supported by an intermediate transfer belt driven roller 182 from a backside thereof.

The paper sheet to which a toner image is transferred as a visible image is guided by the fixing device 20 comprised of a heating roller 20*a* and a pressure roller 20*b*, passes through between the heating roller 20*a* and the pressure roller 20*b*, and subjected to the processing of heating and pressurizing. Thereby, the toner image to be the visible image is fixed firmly on the surface of the paper sheet. The paper sheet on which the toner image has been fixed is discharged by paper discharge rollers 43 onto the paper discharge tray 36. On the heating roller 20*a*, a temperature sensor (such as thermistor, for example) 20*c* is provided, and based on surface temperature detection information of the heating roller 20*a* by the temperature sensor, heat generation control in a heat generating section of the heating roller 20*a* is performed by a control section (not shown).

The image forming apparatus 1 is provided with a paper conveyance path P1 of a substantially vertical direction so that the paper sheet contained in the paper feeding cassette 34 is fed, through between the secondary transfer roller 19 and the intermediate transfer belt 18 and through the fixing device 20, to the paper discharge tray 36. Arranged in the paper conveyance path P1 are a pick-up roller 44 for feeding the paper in the paper feeding cassette 34 into the paper conveyance path P1 sheet by sheet, conveying rollers 45 for conveying the fed paper sheet upward, registration rollers 46 for guiding the conveyed paper sheet between the secondary transfer roller 19 and the intermediate transfer belt 18 at a predetermined timing, and the paper discharge rollers 43 for discharging the paper sheet to the paper discharge tray 36. In addition, inside the image forming apparatus 1, a paper conveyance path P2 on which a pick-up roller 47 and conveyance rollers 48, 49 and 50 are arranged is formed between the manual paper feeding tray 35 and the registration rollers 46. Further, a paper conveyance path P3 is formed from the paper discharge rollers 43 to an upstream side of the registration rollers 46 in the paper conveyance path P1.

The paper discharge rollers 43 are rotatable in both forward and reverse directions, and are driven in the forward direction to discharge a paper sheet to the paper discharge tray 36 during single-sided image formation in which an image is formed on one side of the paper sheet, and during second side image formation of double-sided image formation in which an image is formed on both sides of the paper sheet. On the other hand, during first side image formation of the double-sided image formation, the paper discharge rollers 43 are driven in the forward direction until a tail end of the paper sheet passes through the fixing device 20, and are then driven in the reverse direction to guide the paper sheet in the paper conveyance path P3 in a state where the tail end of the paper sheet is held. In the paper conveyance path P3, a reverse conveyance rollers 51 and 52 are arranged and with these reverse conveyance rollers 51 and 52, the paper sheet on which an image has been formed only on one side during double-sided image formation is guided from the paper conveyance path P3 to the paper conveyance path P1 in a state where the paper is turned over and upside down.

The paper sheet that has been fed from the paper feeding cassette 34 or the manual paper feeding tray 35 and has been conveyed through the paper conveyance path P3 is guided by the registration rollers 46 between the secondary transfer roller 19 and the intermediate transfer belt 18 in synchronization with the rotation of the intermediate transfer belt 18. Thus, the rotation of the registration rollers 46 is stopped when the operation of the photoreceptor drums 2, 3, 4 and 5 or the intermediate transfer belt 18 is started, and the movement of the paper sheet that has been fed or conveyed prior to rotation of the intermediate transfer belt 18 is stopped in the paper conveyance path P1 in a state where a leading end thereof abuts against the registration rollers 46. Then, rotation of the registration rollers 46 is started at timing when the leading end of the paper sheet faces a leading end of a toner image formed on the intermediate transfer belt 18 at a position where the secondary transfer roller 19 is in pressure-contact with the intermediate transfer belt 18.

Note that, during full-color image formation in which image formation is performed by all of the image forming sections 38, 39, 40 and 41, the primary transfer rollers 30, 31, 32 and 33 cause the intermediate transfer belt 18 to be in pressure-contact with all of the photoreceptor drums 2, 3, 4 and 5. On the other hand, during monochrome image formation in which image formation is performed only by the image forming section 38, only the primary transfer roller 30 causes the intermediate transfer belt 18 to be in pressure-contact with the photoreceptor drum 2.

Figure 2:
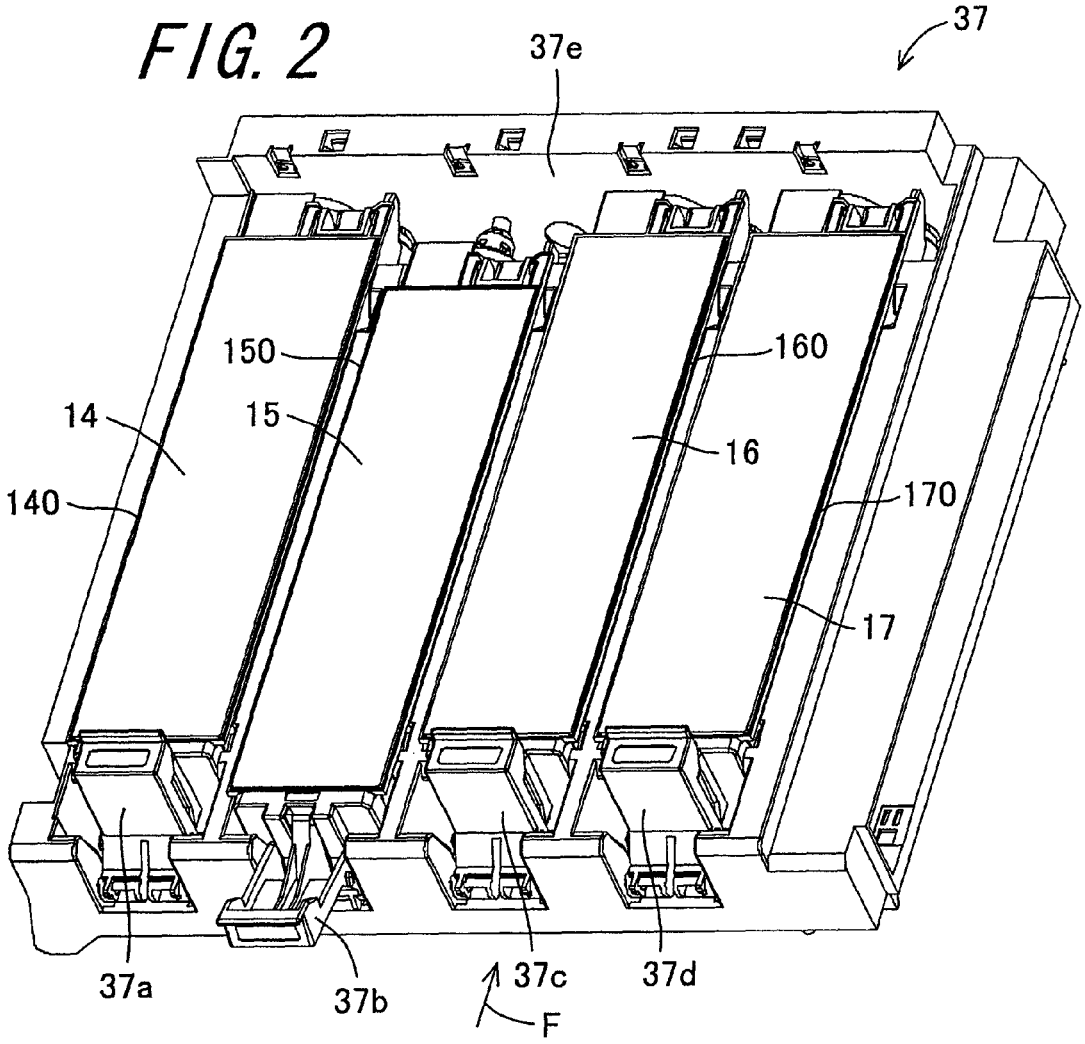
FIG. 2 is a perspective view showing the configuration of a toner cartridge unit having toner cartridges which are mounted on the image forming apparatus.

Next, description will be given in detail for the configuration of the characteristic toner cartridges 14, 15, 16 and 17 according to the embodiment with reference to the drawings. FIG. 2 is a perspective view showing the configuration of a toner cartridge unit 37 in which four pieces of the toner cartridges 14, 15, 16 and 17 are unitized in block. As the toner cartridges 14, 15, 16 and 17, as shown in FIG. 2, four pieces of the toner cartridges 14, 15, 16 and 17 are mounted side by side on the toner cartridge unit 37. When any of lock levers 37*a*, 37*b*, 37*c* and 37*d* provided on the toner cartridge unit 37 corresponding to respective toner cartridges 14, 15, 16 and 17 is raised up, any of toner containers 140, 150, 160 and 170 as toner containers is moved toward an arrow F direction so as to be held in a state of being pressed to a stopper plate 37*e*. In this manner, the toner cartridge unit 37 on which four pieces of the toner cartridges 14, 15, 16 and 17 are mounted side by side is set on the intermediate transfer belt 18. In the set state, it is configured that respective toner containers 140, 150, 160 and 170 and the toner supply pipes 10, 11, 12 and 13 are connected so that corresponding toners are able to be supplied to the developing devices 6, 7, 8 and 9 through toner supply pipes 10, 11, 12 and 13. Note that, FIG. 2 shows a state prior to attachment of a toner cartridge for cyan 15. Operation of a shutter during attachment of the toner cartridges 14, 15, 16 and 17 will be described below in detail in FIGS. 5A to 5C.

Figure 3A:
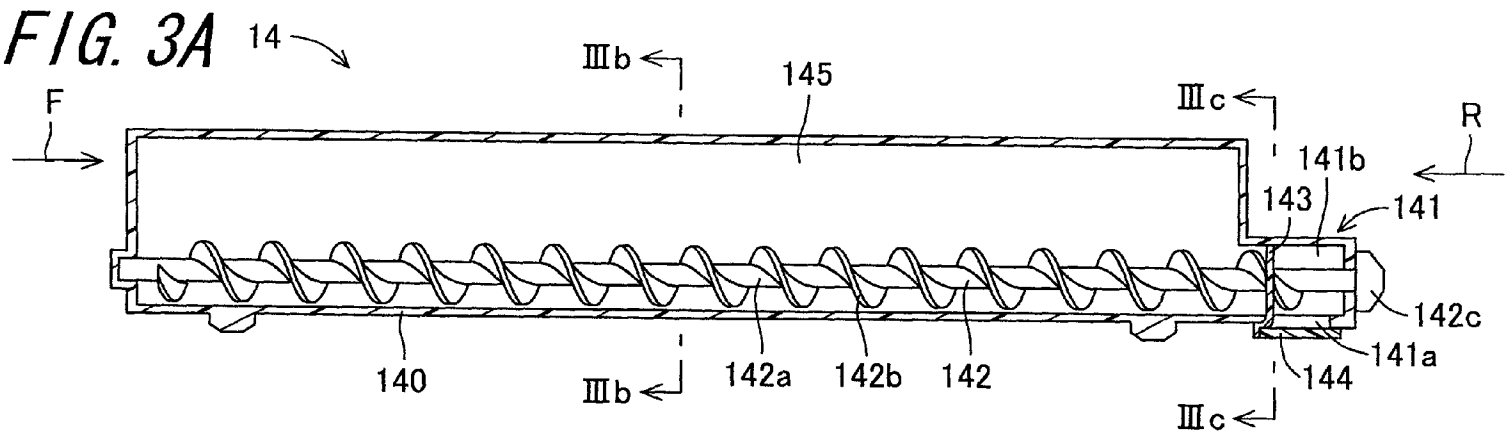
FIGS. 3A to 3C are sectional views showing the configuration of the toner cartridge.
Figure 3B:
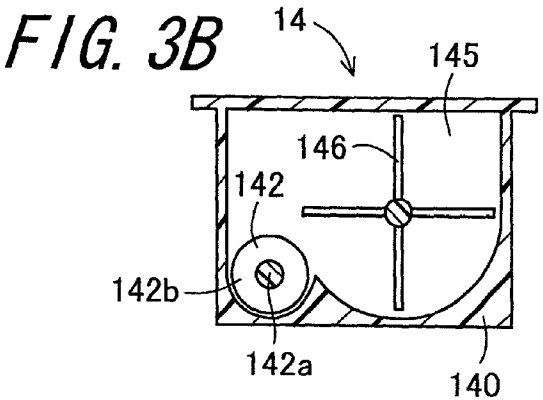
Figure 3C:
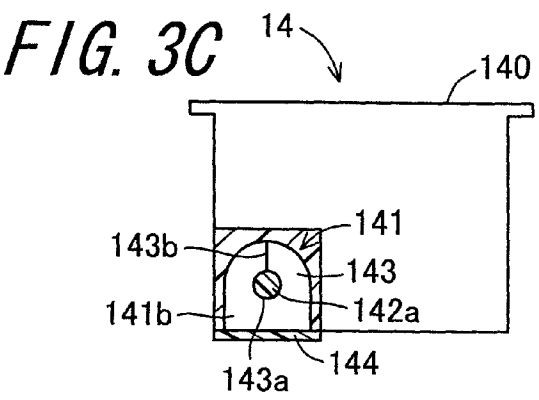
Figure 4A:
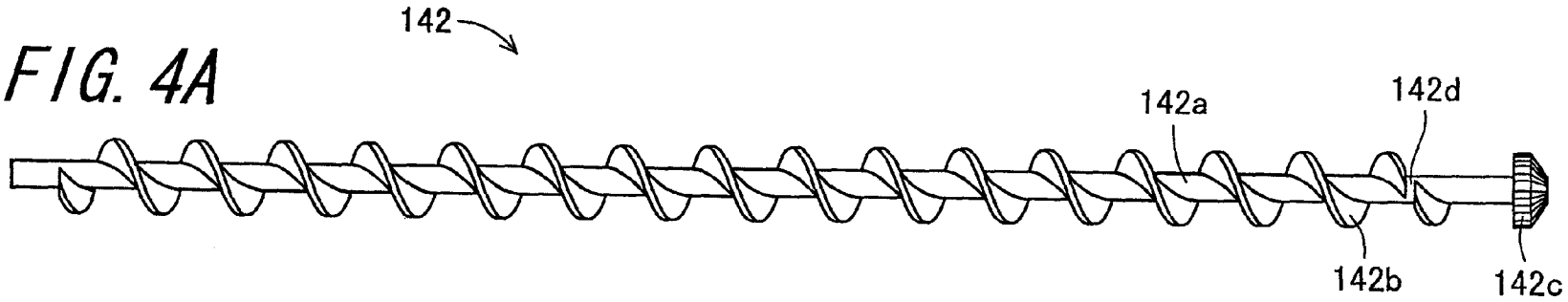
FIGS. 4A and 4B are external views of an auger screw and a toner flowing-out preventing member.
Figure 4B:
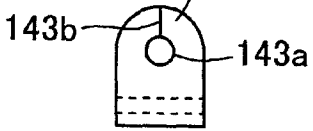
Figure 5A:
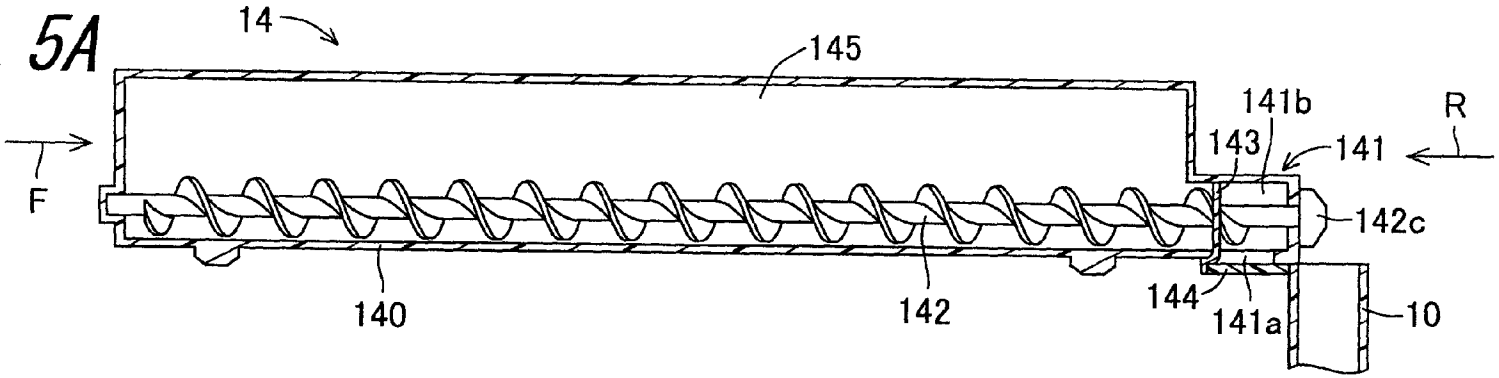
FIGS. 5A to 5C are views showing releasing operation process of the toner flowing-out preventing member during attachment of the toner cartridge in the image forming apparatus.
Figure 5B:
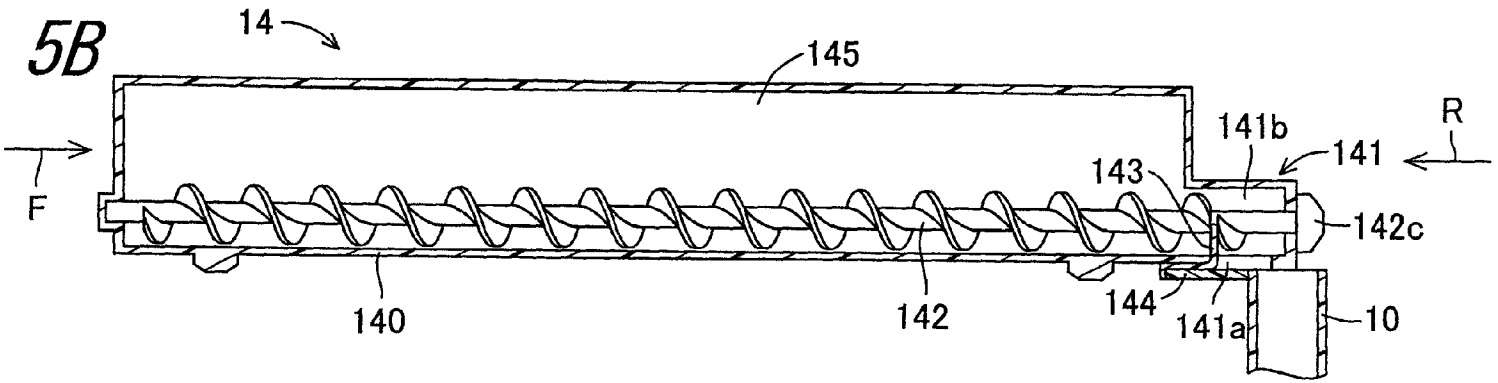
Figure 5C:
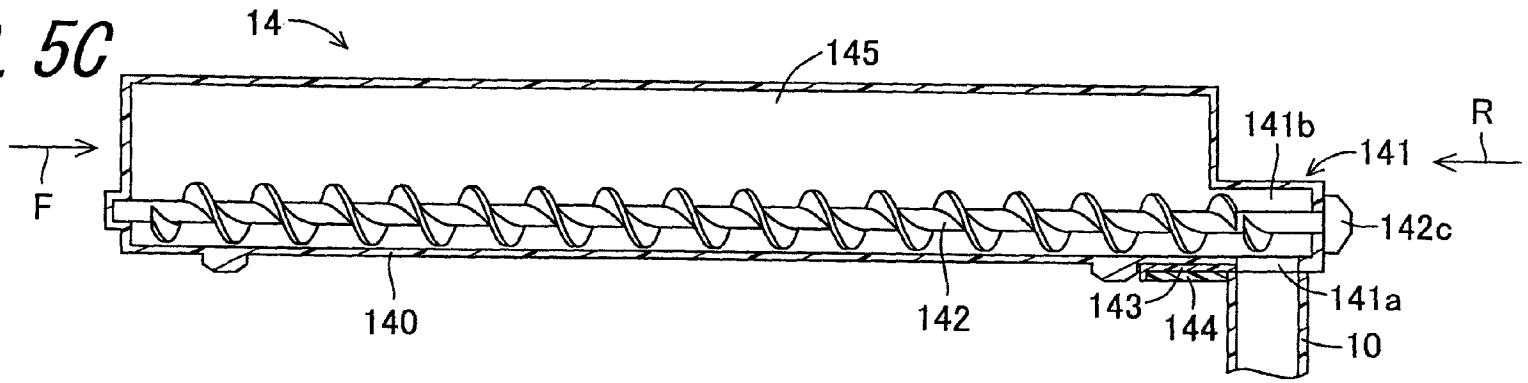

Next, description will be given in detail for the configuration of the toner cartridges 14, 15, 16 and 17 taking an example of the toner cartridge for black 14 with reference to FIGS. 3A to 3C, FIGS. 4A and 4B and FIGS. 5A to 5C. Since other toner cartridges 15, 16 and 17 are configured similarly, description thereof will be omitted. FIGS. 3A to 3C are sectional views showing the configuration of the toner cartridge 14. FIG. 3A shows a side sectional view prior to attachment of the toner cartridge 14 to the image forming apparatus 1, and FIG. 3B shows a sectional view taken along a sectional line IIIb-IIIb of FIG. 3A, and FIG. 3C shows a sectional view taken along a sectional line IIIc-IIIc of the same. FIGS. 4A and 4B show external views of an auger screw 142 and a toner flowing-out preventing member 143. FIG. 4A shows the external view of the auger screw 142 and FIG. 4B shows the external view of the toner flowing-out preventing member 143. FIGS. 5A to 5C are drawings showing releasing operation process of the toner flowing-out preventing member 143 during attachment of the toner cartridge 14 in the image forming apparatus 1.

As shown in FIGS. 3A to 3C, the toner cartridge 14 includes the toner container 140 which contains a black toner, a toner discharge section 141, the auger screw 142 and the toner flowing-out preventing member 143. The toner discharge section 141 is provided on one side part of the toner container 140 and has a toner discharge port 141*a*. The auger screw 142 includes a rotation shaft 142*a* and a spiral blade 142*b* and is provided in the toner container 140 and conveys a black toner in the toner container 140 to the toner discharge section 141. The toner flowing-out preventing member 143 is provided in a communicating part between the toner container 140 and the toner discharge section 141 and prevents flowing out of the toner. The toner discharge port 141*a* is provided with a shutter 144. Furthermore, in a toner containing space 145 of the toner container 140, a stirring paddle 146 which is parallel to the auger screw 142 is rotatably supported.

The toner container 140 includes the toner discharge section 141 which is cylindrical at one end thereof (a tip end side along the arrow F direction), and is a toner container of a substantially square column containing a black toner. The toner container 140 rotatably supports the auger screw 142 and the stirring paddle 146 in the toner containing space 145. A sectional shape of the internal space 141*b* which is enclosed by the toner discharge section 141 and a shutter 144 is a continuous shape of a rectangular part on the side of the shutter 144 and a semi-arc part on a side opposite to the shutter.

The auger screw 142 includes a rotation shaft 142*a*, a spiral blade 142*b*, and a driving gear 142*c*, and the rotation thereof conveys the black toner inside the toner container 140 toward the toner discharge port 141*a*. The stirring paddle 146 is a stirring member that has four pieces of stirring blades around the rotation shaft and functions to disintegrate the black toner in the toner container 140 by the rotation. The toner discharge port 141*a* is a rectangular opening provided on a bottom part of the toner discharge section 141 of the toner container 140, and discharges the black toner carried by the auger screw 142 to the outside of the toner cartridge 14. The shutter 144 is a shutter member formed in a rectangular plate shape slidably provided to a position of closing the toner discharge port 141*a*, and it is configured that when attached to the image forming apparatus 1, receiving action of an upper end of the toner supply pipe 10, slidingly moves in the arrow R direction against resilience of a spring of which illustration is omitted, so as to open the toner discharge port 141*a*. By opening thereof, the black toner contained in the toner container 140 is supplied to the developing device 6 through the toner supply pipe 10.

The toner flowing-out preventing member 143 is comprised of a plate-like member having flexibility, whose entire shape is formed to be almost the same shape as the sectional shape of the internal space 141*b*. The toner flowing-out preventing member 143 includes a circular hole section 143*a* which has the same shape as the vertical section of the rotation shaft 142*a* of the auger screw 142, and is arranged in the communicating part that divides the toner container into the toner discharge section 141 and the toner containing space 145. As to the toner flowing-out preventing member 143, one end (lower end) thereof is fixed to a tip end and side end along the arrow R direction of the shutter 144 by an adhesive so as to stand vertically through inside the toner discharge port 141*a*, and inserts a rotation shaft 142*a* of the auger screw 142 into the circular hole section 143*a* so as to be held by the auger screw 142 in a state of being perpendicular to the axial line of the rotation shaft 142*a*. Then, in this state, an outer peripheral part of the toner flowing-out preventing member 143 is in a state of closely attached to an inner wall of the toner discharge section 141. Therefore, the toner flowing-out preventing member 143 acts as a seal member so that the black toner on the toner containing space 145 side does not flow out to the toner discharge section 141 side in the toner cartridge 14 prior to attaching to the image forming apparatus 1.

The toner cartridge 14 is arranged above the developing device 6 as shown in FIG. 1 so as to supply a black toner to the developing device 6 by being connected to the toner supply pipe 10, however, prior to attaching the toner cartridge 14 to the apparatus main body, the black toner in the toner container 140 is shielded by the toner flowing-out preventing member 143 so as not to flow out to the toner discharge section 141. The toner flowing-out preventing member 143 is so configured that since the lower end thereof is fixed to the end of the shutter 144, the toner flowing-out preventing member 143 is drawn out to the outside of the toner container 140 in conjunction with the sliding operation of the shutter 144 in opening the toner discharge port 141*a*. Then, as shown in FIG. 3C and FIG. 4B, the toner flowing-out preventing member 143 further has a cutting slit section 143*b* from the circular hole section 143*a* to the peripheral part (forming a semi-arc) of a region corresponding to the semi-arc part of the internal space 141*b*. Thereby, when the shutter 144 is slid so that the toner flowing-out preventing member 143 is drawn out to the outside of the toner container 140, the slit section 143*b* is widely opened so that the toner flowing-out preventing member 143 comes off the rotation shaft 142*a*, and the load of the toner flowing-out preventing member 143 departing from the auger screw 142 becomes small, and thus release of the toner flowing-out preventing member 143 is achieved further smoothly.

Further, in the embodiment, as shown in FIG. 4A, at a position where the spiral blade 142*b* of the auger screw 142 intersects with the toner flowing-out preventing member 143, a notch section 142*d* for the toner flowing-out preventing member having a width equal to or more than the thickness (slightly larger in width) of the toner flowing-out preventing member 143 is provided. The notch section 142*d* is formed such that in the holding state of the toner flowing-out preventing member 143 by the auger screw 142, a part of the toner flowing-out preventing member 143 is positioned inside the notch section 142*d*. Thereby, sealability between the auger screw 142 and the toner flowing-out preventing member 143 is able to be enhanced so that even though the auger screw 142 rotates in transporting the toner cartridge 14, the spiral blade 142*b* does not act on the toner flowing-out preventing member 143, and the toner flowing-out preventing member 143 is stably held without being deformed or fallen down, therefore, action to prevent flowing out of the black toner in the toner containing space 145 is maintained.

FIGS. 5A to 5C show a state where, in attaching the toner cartridge 14 to the image forming apparatus 1, the shutter 144 slidingly moves and the toner flowing-out preventing member 143 departs from the auger screw 142 so as to be drawn out to the outside of the toner container 140. FIG. 5A shows a state immediately before attaching the toner cartridge 14 to the image forming apparatus 1, that is, a state where the shutter 144 is closed, FIG. 5B is a state in the middle of attaching the toner cartridge 14 to the image forming apparatus 1, that is, a state where the shutter 144 is half-opened, and FIG. 5C shows a state immediately after attaching the toner cartridge 14 to the image forming apparatus 1, that is, a state where the toner flowing-out preventing member 143 departs from the auger screw 142 to be drawn out to the outside of the toner container 140 so that the black toner is able to be discharged to the toner supply pipe 10.

The shutter 144 is maintained at a position of closing the toner discharge port 141*a* by the elastic force of a shot-shown spring, and when the toner cartridge 14 is attached to the image forming apparatus 1 along an arrow F direction, as shown in FIG. 5A, the shutter 144 is arranged to be in contact with the toner supply pipe 10 provided in the insertion route thereof. Then, when the toner cartridge 14 is pressed to proceed toward a predetermined position of the image forming apparatus 1 along the arrow F direction, as shown in FIG. 5B, the shutter 144, receiving action of an upper end of the toner supply pipe 10, slides to be pressed back against the resilience of the spring along the arrow R direction so as to open the toner discharge port 141*a*. At this time, as to the toner flowing-out preventing member 143, since the lower end thereof is fixed to the shutter 144, drawing out thereof is performed so as to be drawn in between the outer surface of the toner container 140 and the shutter 144 in conjunction with the sliding operation of the shutter 144. Along with this, the slit section 143*b* of the toner flowing-out member 143 widely opens so that the circular hole section 143*a* comes off the rotation shaft 142*a* of the auger screw 142, and thereby the toner flowing-out preventing member 143 is released from the state of being held and restrained by the auger screw 142 to depart therefrom.

When attachment of the toner cartridge 14 to a predetermined position in the image forming apparatus 1 is completed, as shown in FIG. 5C, the shutter 144 opens the toner discharge port 141*a* completely and at the same time, the toner flowing-out preventing member 143 departs from the auger screw 142 completely to intervene between the toner container 140 and the shutter 144 in a state of being pressed into. Thereby, as well as the toner discharge port 141*a* is connected with the toner supply pipe 10, the toner containing space 145 communicates with the toner supply pipe 10. Further, the driving gear 142*c* is connected to a power train or a driving source (not shown) in the image forming apparatus 1. Then, when rotation driving around the axial line of the auger screw 142 is started by obtaining the driving force from the power train or the driving source, the black toner in the toner containing space 145 is discharged to the toner supply pipe 10 smoothly through the toner discharge section 141 and the toner discharge port 141*a* without the auger screw 142 locked by the fixed toners. Thereby, the black toner is supplied to the developing device 6 as needed to carry out image forming operation in the image forming section 38 without a hitch. When the black toner in the toner cartridge 14 has run out, the toner cartridge 14 is drawn out along the arrow R direction and replaced with a new toner cartridge 14. In drawing out the toner cartridge 14, the shutter 144 is released from the restraint by the toner supply pipe 10 to slidingly move to an original position by the resilience of the spring so that the toner discharge port 141*a* is closed. Accordingly, in the work of drawing out and taking out the toner cartridge 14 which has been emptied, there will be no spilling out of the black toner remaining in the toner cartridge 14 from the toner discharge port 141*a* to the inside of the image forming apparatus 1.

Figure 6:
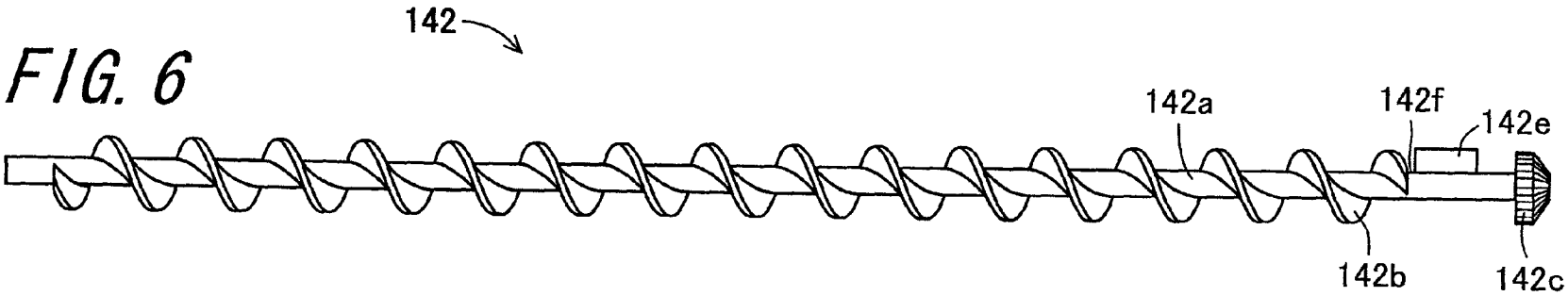
FIG. 6 is an external view of the auger screw according to a second embodiment of the invention.

FIG. 6 is an external view of the auger screw 142 showing a second embodiment of the invention. The auger screw 142 of the embodiment includes a stirring plate 142*e* which is fixed to the rotation shaft 142*a* at a position facing the toner discharge port 141*a* in the toner discharge section 141, adding to the rotation shaft 142*a*, the spiral blade 142*b*, and the driving gear 142*c* which are the same as those described above. The stirring plate 142*e* is a rectangular plate-like member extended radially from the rotation shaft 142*a* to be fixed, and functions to disintegrate and scrape down the toner near the toner discharge port 141*a* by rotating along with the rotation of the rotation shaft 142*a*. Furthermore, the auger screw 142 has a notch section 142*f* for the toner flowing-out preventing member whose thickness is equal to or more than the thickness of the toner flowing-out preventing member 143 at a position intersecting with the toner flowing-out preventing member 143 (illustration thereof is omitted), that is between the spiral blade 142*b* and the stirring plate 142*e*. Thereby, as same as the notch section 142*d* for the toner flowing-out preventing member shown in FIG. 4A, as well as sealability between the auger screw 142 and the toner flowing-out preventing member 143 is able to be enhanced, stable holding of the toner flowing-out preventing member 143 is also achieved.

Note that, although the image forming apparatus 1 of the embodiment is a full-color image forming apparatus, it may be an image forming apparatus exclusively used for monochrome. Moreover, the full-color image forming system is not limited to the tandem type as illustrated, and may be performed by another type. Further, as the developing device, an example of using the two-component developer is shown, however, a developing device of a developing system with a non-magnetic one component developer etc., may be usable.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner cartridge comprising:

a container for containing toner, having an opening for discharging the contained toner;

a toner discharge section provided through a communicating part at a side part of the container where the opening is provided, having a discharge port for discharging toner;

an auger screw provided with a rotation shaft and a spiral blade and rotatably supported in the container, for conveying toner in the container from the opening to the toner discharge section;

a shutter for opening and closing the discharge port; and a toner flowing-out preventing member provided in the communicating part, for opening and closing the opening, the toner flowing-out preventing member being operated in conjunction with the shutter such that when the discharge port is in an opened state, the opening is in an opened state, and when the discharge port is in a closed state, the opening is in a closed state, wherein a cross section of an internal space, taken perpendicular to a longitudinal axis of the rotation shaft and enclosed by the toner discharge section and by the shutter, includes a rectangular part on a shutter side and a semi-arc part on a side opposite the shutter, wherein the rectangular part and semi-arc part join each other, and the toner flowing-out preventing member having a circular hole section whose shape is the same as a cross-sectional shape of the rotation shaft of the auger screw, having an entire shape the same shape as a cross-sectional shape of the internal space, and having a side end of the rectangular part fixed to the shutter, and when the opening is in the closed state, the rotation shaft of the auger screw is inserted to the circular hole section, and the toner flowing-out preventing member is held by the auger screw in a state of being perpendicular to an axial line of the rotation shaft.

2. The toner cartridge of claim 1, wherein a notch section for the toner flowing-out preventing member having a width equal to or more than a thickness of the toner flowing-out preventing member is provided on the spiral blade of the auger screw, and when the opening is in the closed state, a part of the toner flowing-out preventing member is positioned in the notch section.

3. The toner cartridge of claim 1, wherein the toner flowing-out preventing member has a notch from the circular hole section to a peripheral part of a region corresponding to the semi-arc part of the internal space.

4. An image forming apparatus comprising:

a photoreceptor drum on which an electrostatic latent image is to be formed;

a developing device for developing a toner image by supplying toner to the electrostatic latent image formed on the surface of the photoreceptor drum;

the toner cartridge of claim 1, for supplying toner to the developing device;

a transfer device for transferring on a recording medium the toner image developed on the surface of the photoreceptor drum; and a fixing device for fixing the transferred toner image on the recording medium.

* * * * *